United States Patent [19]

Chensky

[11] 4,042,292

[45] Aug. 16, 1977

[54] WALL PLATE STRUCTURE

[76] Inventor: Frank T. Chensky, 20013 Thornlake, Cerritos, Calif. 90701

[21] Appl. No.: 603,716

[22] Filed: Aug. 11, 1975

[51] Int. Cl.[2] ..... H01R 13/62

[52] U.S. Cl. ..... 339/45 R; 339/46

[58] Field of Search ..... 339/36, 45, 46; 16/171

[56] References Cited

U.S. PATENT DOCUMENTS

| | | | |
|---|---|---|---|
| 2,551,553 | 5/1951 | Gernheuser | 339/45 R |
| 2,732,581 | 1/1956 | Heck | 16/171 X |
| 2,977,564 | 3/1961 | Civitell et al. | 339/45 R |

*Primary Examiner*—Roy Lake
*Assistant Examiner*—Mark S. Bicks

[57] ABSTRACT

A replacement cover plate for a conventional wall outlet is disclosed, the cover plate being modified to include pivoted release plates disposed over each plug receptacle. Each release plate is conformed to the plan form of the receptacle itself and includes in the face thereof the necessary openings for receiving the terminals of a plug. Formed on the wall plate, adjacent to one edge of each receptacle are two opposed tabs adapted to receive a cylindrical fulcrum extending from the adjacent surface of the corresponding release plate. Extending from each release plate, distal of the fulcrum, is a cantelevered, raised projection or lever which when manually depressed will pivot the release plate away from the adjacent receptacle. Thus a plug inserted through the openings in the release plate and received in the receptacle will be withdrawn out of the receptacle by the articulation of the release plate.

1 Claim, 4 Drawing Figures

WALL PLATE STRUCTURE

BACKGROUND OF THE INVENTION

1. Field of the Invention

The present invention relates to electrical outlet devices, and more particularly to release devices associated with a wall outlet.

2. Description of the Prior Art

One of the more common events in the life of present day man is insertion and withdrawal of plugs attached to various appliances into and out of electrical outlets. This event in fact has become so common that in many instances the steps taken during such an event are made with a less than the required care necessary for the operation. Particularly when withdrawing the plug from the outlet a person, rather than grasping the plug itself, will pull or yank on the cord extending from the plug, with the resulting damage to the plug and more importantly with the resultant hazard of exposing uninsulated parts of the cord. Generally, in order to provide good contact within the receptacle itself, the mating interface between the terminal of the plug and the terminals of the receptacle rely on friction fit. As a consequence the force levels necessary to withdraw the plug from the receptacle are often necessarily high. This feature is compounded by the frequent arrangement of furniture in places where manual reach directly to the outlet is less than comfortable. Thus the user of an appliance will often, when removing the plug, yank on the cord. In the prior art many devices have been devised for a more convenient withdrawal sequence. Most such devices, however, entail many operating parts and therefore are difficult to install for the typical user. Furthermore, because of the wide tolerances in manufacture and various design approaches to the plug-to-receptacle mating interface, the use of such prior art withdrawal aids often render a proper connection impossible.

SUMMARY OF THE INVENTION

Accordingly it is the general purpose and object of the present invention to provide a wall plate which includes pivoted release plates mounted thereon, each release plate being aligned with the receptacle in the wall plate.

Other objects of the invention are to provide pivotal release plates on a wall plate which can be selectively removed.

Yet further objects of the invention are to provide releasing devices for a conventional wall outlet which are easy to produce, require few parts, and are furthermore easily installed.

These and other objects are accomplished within the present invention by modifying a conventional electrical outlet wall plate to include, adjacent each receptacle opening, two opposed tabs. Receivable between the two opposed tabs is a cylindrical fulcrum extending from the underside of the juncture between the release plate and a cantelevered lever extending therefrom, whereby manual depression of the cantelevered lever will concurrently rotate the release plate about the fulcrum. Formed in the face of the release plate are the requisite openings for receiving the terminals of the plug, the release plate and the opening being aligned by the fulcrum and the projecting tabs on the wall plate to align with the openings for the corresponding receptacle. Thus a plug having the terminals thereof inserted through the openings in the release plate and into the contact openings of the wall receptacle will be withdrawn from the receptacle by the pivotal articulation of the release plate. Should the thickness of the release plate prevent proper contact between the terminals on the plug and the contacts in the receptacle each release plate is removable by arranging the dimensions separating the free ends of the tabs to be just slightly smaller than the maximum dimension of the cylindrical fulcrum. To allow for rotational freedom of the cylindrical fulcrum within the gap between the tabs the free ends of the tabs are bent towards each other with the result that the gap below the ends and between the tabs is greater than the end gap between the tabs.

It is further contemplated for the use herein that such tabs and the wall plates itself be made of a material like plastic and are therefore partly deformable. Thus on withdrawal the oversize cylindrical fulcrum will force outwardly the tab ends, effecting a release.

DESCRIPTION OF THE SPECIFIC EMBODIMENT

While the following description is specifically directed to a conventional electrical outlet having a pair of receptacles, such is for purposes of illustration only. It is contemplated that the use of the invention herein can be adapted to various other plug configurations and no intent is therefore expressed by the selection of the example therein.

Figure 1:
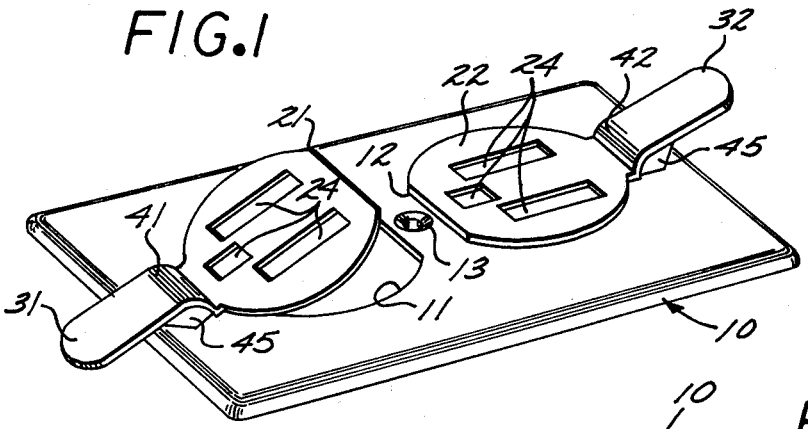
FIG. 1 is a perspective illustration of an electrical outlet wall plate modified according to the present invention.

As shown in FIG. 1 a conventional wall plate, generally designated by the numeral 10, includes in the face thereof, two openings 11 and 12 formed to align with the conventional paired wall outlet receptacles (not shown). Wall plate 10, as commonly practiced, is secured to the receptacle housing by way of a screw which is insertable through a mounting hole 13 formed intermediately to openings 11 and 12. Disposed over each opening 11 and 12, and conformed to the plan dimensions thereof are corresponding release plates 21 and 22 each including the requisite terminal receiving openings therein, shown as openings 24. Openings 24 are disposed in the surface of release plate 21 and 22 to align with the corresponding contact openings in the plug. Thus, openings 24 will include an opening for insertion of the ground terminal and the positive and negative terminals of a conventional outlet. In order to accommodate the various tolerances of manufacture and the various misalignment tolerances when installed, openings 24 are made oversize, their only function being to permit insertion of the plug into the receptacle.

Shown extending from the distal edges of the release plates 21 and 22 are corresponding cantelevered projections or levers, respectively designated as levers 31 and 32. Levers 31 and 32 are joined to the corresponding release plates by way of a convolved joining surface, designated herein as joining surfaces 41 and 42, which align the respective levers above the plane of the corresponding release plate and furthermore align the orientation thereof away from the wall plate. In order to achieve this alignment the joining surfaces 41 and 42 each are formed in the manner of a cylindrical section, joining along one longitudinal edge the edge of the release plate and terminating at the other longitudinal end in the corresponding lever. In order to strengthen levers 31 and 32 in bending, or more particularly in order to strengthen the end fixity of the corresponding levers with respect to the release plate, there is formed along each lateral edge of the joining surfaces 41 and 42, a plurality of webs designated herein by the common numeral 45. Webs 45 increase the sectional moment of inertia at the root of the corresponding levers 31 and 32 and provide further structural functions to be elucidated hereinbelow.

Figure 2:
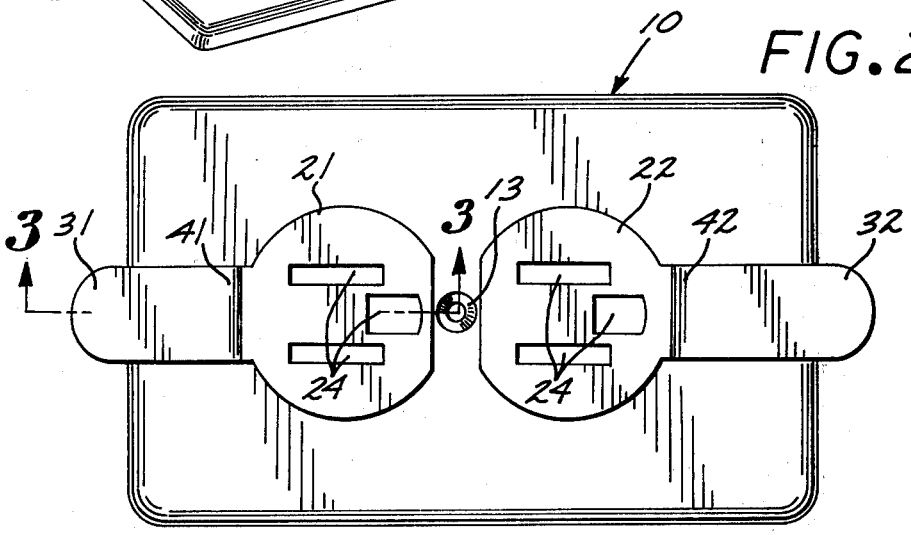
FIG. 2 is a plan view of the inventively modified wall plate shown in FIG. 1.

These same features are illustrated in FIG. 2. More specifically, FIG. 2 shows the orientation of openings 24 when the wall plate 10 is used with what is commonly referred to as grounded receptacle. For this reason the disposition of openings 24 on the corresponding release plates 21 and 22 is not symetrical since in conventional practice the grounded terminal is always to one side of the receptacle.

Figure 3:
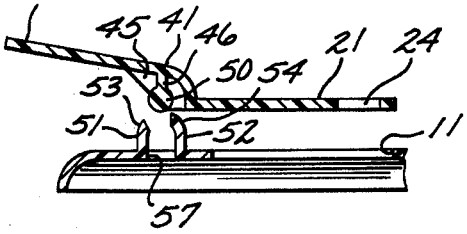
FIG. 3 is a side view in partial cross section taken along line 3—3 of FIG. 2.

The details of the pivotal attachment of release plate 21 are shown in FIG. 3, it being understood that release plate 22 and the associated mounting thereof be similarly constructed. More specifically, extending downwardly from the underside of the joining surface 41 is a transverse, vertical surface 36 joined at either end to the laterally disposed webs 50. Formed along the transverse free edge of surface 46 and similarly extending between the lateral webs 50 is a cylindrical bead or fulcrum 50 which is receivable between two opposed tabs 51 and 52 formed on the exterior of the wall plate 10. Tabs 51 and 52 are longitudinal dimensioned for receipt in the gap between webs 45 and include at the free edges thereof inwardly turned sections 53 and 54. Sections 53 and 54 are turned to oppose each other, the ends thereof being furthermore separated by a gap which is slightly smaller than the diameter of the cylindrical fulcrum 50. To further accommodate insertion of fulcrum 50 into the interior between tabs 51 and 52 the free edges of projections 53 and 54 are cut along an inward taper, thus guiding fulcrum 50 into a receiving alignment between the tabs.

Since it is contemplated that the elements of the inventively modified wall plate herein be produced from plastic by a technique known as injection molding and since such a technique normally involves relatively high tolerances of manufacture, the relationship of the cylindrical fulcrum 50 relative the bend in the tabs 51 and 52 is not conveniently controllable. Thus the amount of surface contact of the cylindrical fulcrum 50 relative the other part will affect the friction levels in the joint and therefore will affect the amount of force necessary to articulate the release plate. In order to limit such surface contact the surface section of wall plate 10 between tabs 51 and 52 is cut out to form an opening shown as opening 57. This opening is longitudinally dimensioned to provide opposing surface contact proximate the ends of fulcrum 50 only. Thus the contact surfaces are primarily the engaging surfaces between tabs 51 and 52 and the cylindrical fulcrum. This arrangement of opening 57, in addition to the functions stated above, reduces the mass content within a localized area of the die thus permitting a more convenient molding operation.

Figure 4:
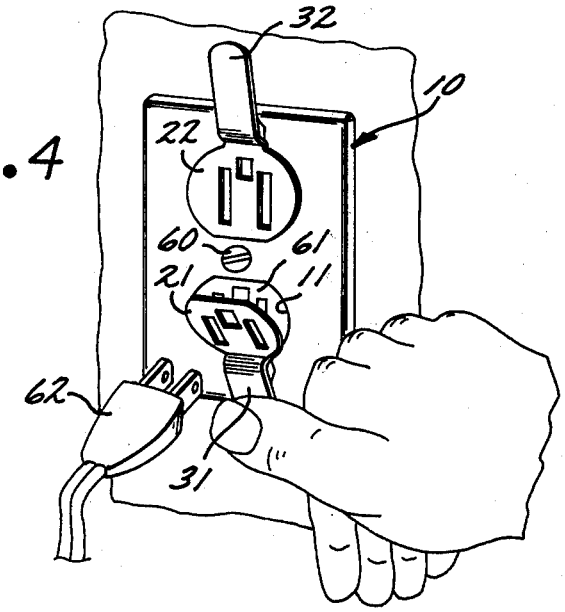
FIG. 4 is yet another perspective illustration of the inventively modified wall plate illustrating the operation thereof.

The operation of the present invention will now be set forth with particular reference to FIG. 4. As shown in FIG. 4 wall plate 10 is secured by way of a securing screw 60 to the screw hole between the receptacles or the receptacle housing (not shown). A receptacle shown as a receptacle 61 is thereby aligned in opening 11. A plug 62 once inserted through openings 24 into receptacle 61, is then withdrawn from the receptacle 61 by the articulation of the release plate 21 through manipulation of lever 31. More specifically shown in this figure manual depression of the extending cantelevered lever 31 will rotate the release plate 21 away from the underlying receptacle 61 withdrawing the plug. It is to be noted that the operation of release plate 22 is similarly implemented and the illustration shown herein is similarly explanatory of the functioning thereof.

Some of the many advantages of the present invention should be now readily apparent. The invention provides by way of simple mechanical parts a device for assisting the withdrawal of electrical plugs from electrical outlets, where both the function and the installation of the device is straight forward, requiring minimal skills by the user. This the invention provides in a device which is easy to produce, simple to maintain and therefore reliable in operation.

Obviously many modifications and variations to the above disclosure can be made without departing from the spirit of the invention. It is therefore intended that the scope of the invention be determined solely dependent on the claim hereto.

I claim:

1. In combination with a wall mounted receptacle that includes first and second spaced, prong receiving outlets, each of said outlets capable of removably receiving a pair of electrical conducting prongs that project from an insulated plug mounted on a free end of an electrical conducting cord, a wall plate assembly, said assembly including:

a. a cover plate molded from a polymerized resin, said cover plate at least as great in transverse cross-section as that of said receptacle and adapted to conceal the latter when said cover plate overlies said receptacle, said cover plate having first and second openings that are aligned with said first and second outlets, said cover plate including first and second pairs of spaced tabs extending outwardly from said plate adjacent said first and second openings, said cover plate having a slot formed between each of said pair of tabs;

b. first and second release plates that in first positions overlie said openings and are conformed in plan form to the dimensions of said openings, said first and second plates each having a pair of spaced openings therein through which said pair of prongs of one of said plugs may extend to removably engage one of said prong receiving outlets; first and second handles that extend outwardly in opposite directions from said first and second plates; and first and second cylindrical fulcrums that extend outwardly from said first and second plates adjacent said first and second handles, said first and second cylindrical fulcrums pivotally and removably engaging said first and second pairs of tabs, said fulcrums being conformed for receipt between said tabs, said tabs having parallel surfaces extending vertically from said cover plate, each of said surfaces terminating at a free edge thereof in a turned extension, the respective extensions being directed toward each other to form a gap less than the sectional dimension of a respective fulcrum for insert of said fulcrums between said tabs and adjacent a respective slot; and, c. first means for removably securing said cover plate to said receptacle for said cover plate and first and second release plates to conceal said receptacle and first and second outlets when said first and second cover plates are in said first position, with said first and second plates when manually moved from said first position to a second position displacing the one of said plugs most adjacent thereto from engagement with one of said outlets, and said release plates being removable from said cover plate without removing the latter from said receptacle.

* * * * *